United States Patent [19]

Kolesar

[11] 4,399,492

[45] Aug. 16, 1983

[54] INCANDESCENT AND FLUORESCENT CAPLIGHT DEVICE

[75] Inventor: Henry R. Kolesar, Mundelein, Ill.

[73] Assignee: Ocenco Incorporated, Northbrook, Ill.

[21] Appl. No.: 214,132

[22] Filed: Dec. 8, 1980

[51] Int. Cl.[3] ..... F21L 15/14

[52] U.S. Cl. ..... 362/106; 362/216; 362/231; 362/240; 362/260

[58] Field of Search ..... 362/105, 106, 227, 230, 362/234, 240, 164, 216, 103, 231, 260, 285, 362, 371

[56] References Cited

U.S. PATENT DOCUMENTS

| | | | |
|---|---|---|---|
| 3,220,327 | 11/1965 | Hunger | 362/216 |
| 3,287,551 | 11/1966 | Dick | 362/216 |
| 3,953,725 | 4/1976 | Ketler et al. | 240/51.11 R |
| 4,002,895 | 1/1977 | Ketler et al. | 240/60 |
| 4,225,906 | 9/1980 | Gulliksen | 362/106 |

FOREIGN PATENT DOCUMENTS

| | | | |
|---|---|---|---|
| 537668 | 3/1957 | Canada | 362/216 |

*Primary Examiner*—Donald P. Walsh

*Attorney, Agent, or Firm*—Fitch, Even, Tabin & Flannery

[57] ABSTRACT

This invention relates to an illuminating device for mounting on a cap such as a hard hat.

14 Claims, 9 Drawing Figures

INCANDESCENT AND FLUORESCENT CAPLIGHT DEVICE

BACKGROUND OF THE INVENTION

The most commonly used illuminating device worn on a hard hat by miners, construction workers, or others employs a single incandescent bulb which is connected by a power cable to a battery pack adapted to be clipped to the belt of the wearer. Usually the battery is a 3.6 or four volt battery. The incandescent bulb is hermetically sealed within a housing to prevent methane gas from being ignited by the hot incandescent filament. The front lens is usually of glass and if it breaks, the incandescent bulb is spring biased to shift forward and open its energizing circuit to prevent ignition of methane gas. One problem with such incandescent bulbs is that they project only spot beam, usually of about 40 to 50 lumens, and hence do not provide much peripheral or side lighting.

Another form of illuminating device worn on a hard hat is disclosed in U.S. Pat. Nos. 3,953,725 and 4,002,895, which disclose a fluorescent bulb in a sealed housing attached to a hard hat. While the fluorescent lamp was able to provide increased lumens and better peripheral lighting, the device was large and included a large, oblong housing which struck, laterally outward from the sides of the hard hat and could be caught on or hit against obstructions while the wearer was working.

The safety codes of various occupations are quite stringent as to the requirements of the illuminating device. It must operate off a low voltage power source and for an extended period of time before being recharged. For instance, a typical miner's illuminating device should operate 10 hours before having to be recharged, should operate from a 4 volt battery. Further, the luminating device must be lightweight so that the wearer does not have an uncomfortable weight on his head. Further, as above explained, the preferred illuminating device should fit within a small volume, for example, less than about $3\frac{1}{2}''$ on each side.

Accordingly, an object of the present invention is to provide a new and improved illuminating device for wearing on a cap.

Another object of the invention is to provide an illuminating device for a cap which selectively provides for either a spot beam or for a wider beam with more peripheral lighting.

A still further objective of the invention is to provide a cap lighting device having both an incandescent and fluorescent light bulb within the same housing.

These and other objectives and advantages of the invention will become apparant from the following detailed discussion taken in connection with the accompanying drawings in which.

Figure 1:
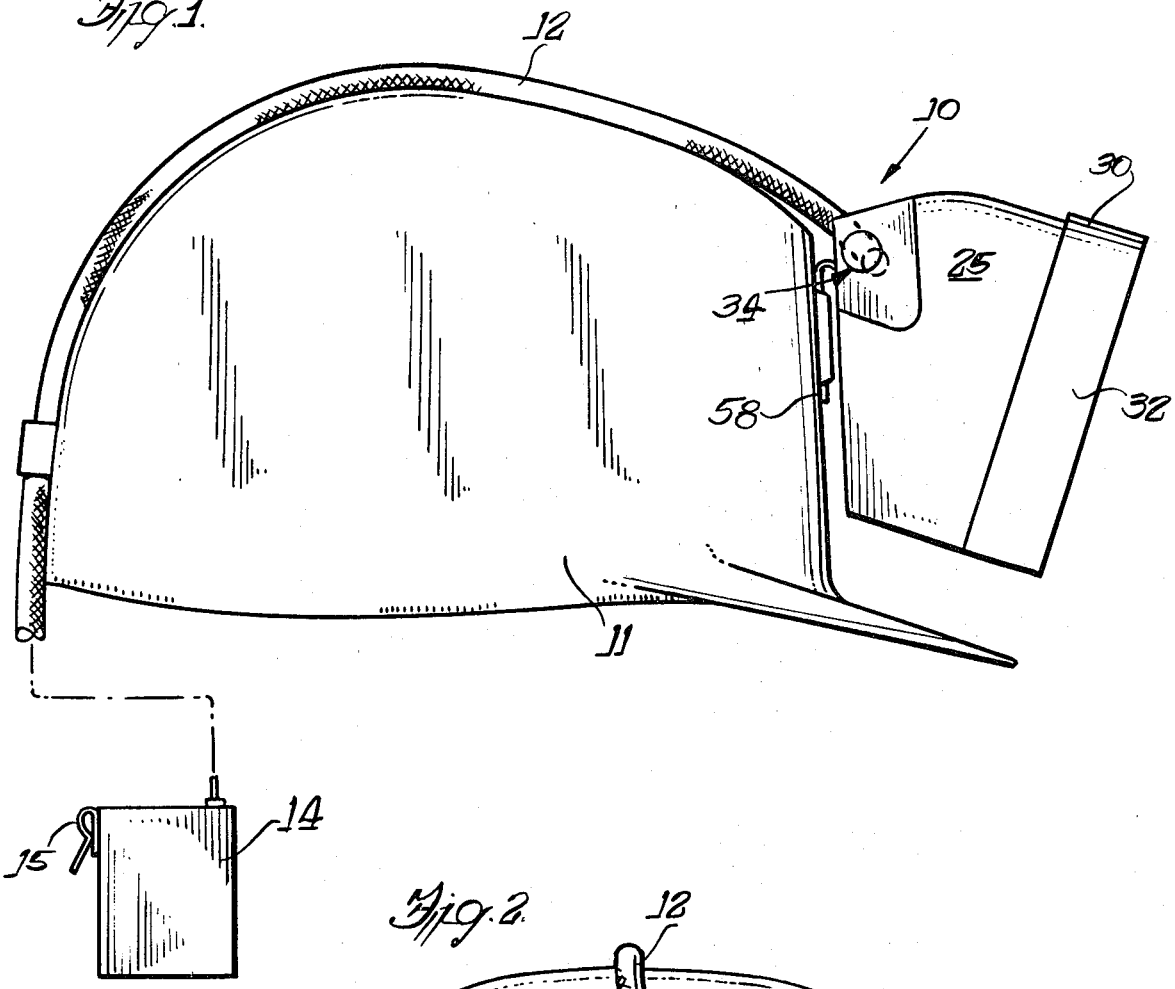
FIG. 1 is an elevational view of a caplight, hard hat and battery to be worn and embodying the invention.
Figure 2:
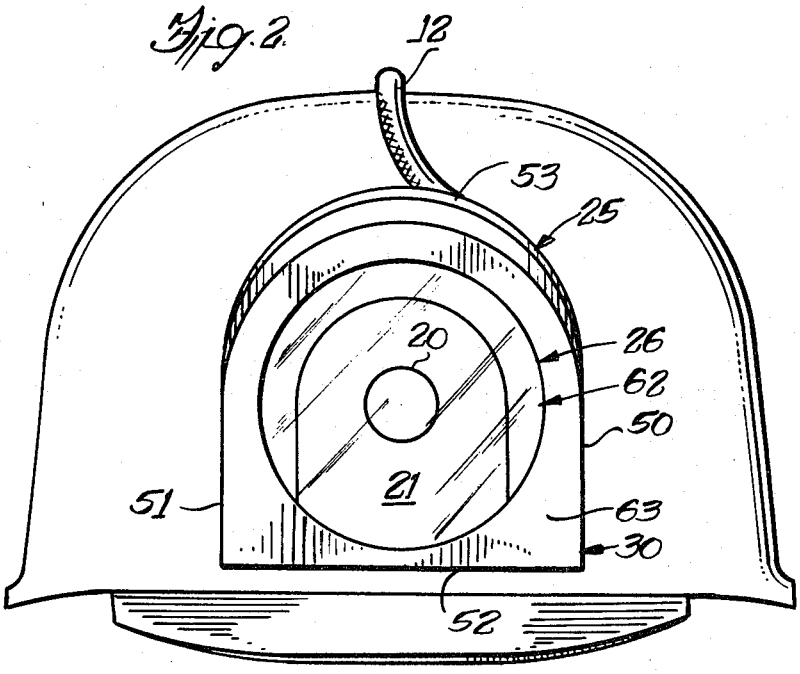
FIG. 2 is a front elevational view of the cap of FIG. 1.
Figure 3:
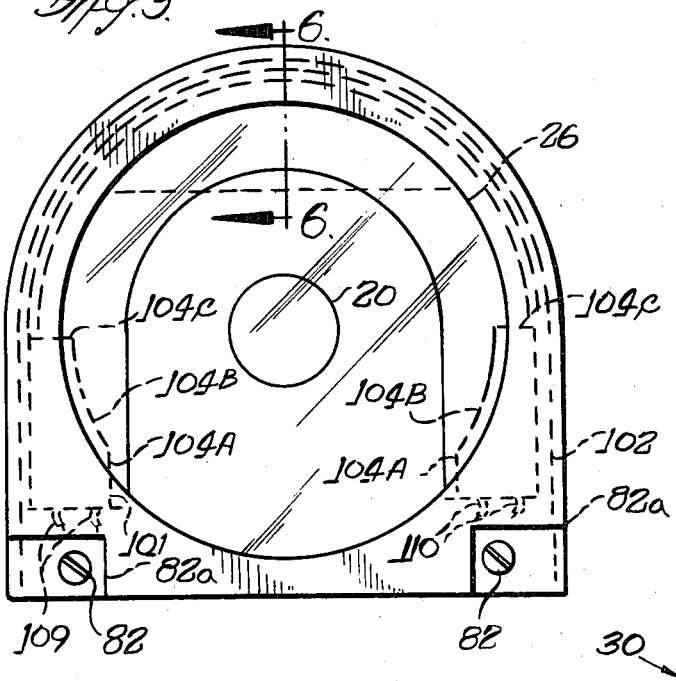
FIG. 3 is a front elevational view of cap light device.
Figure 6:
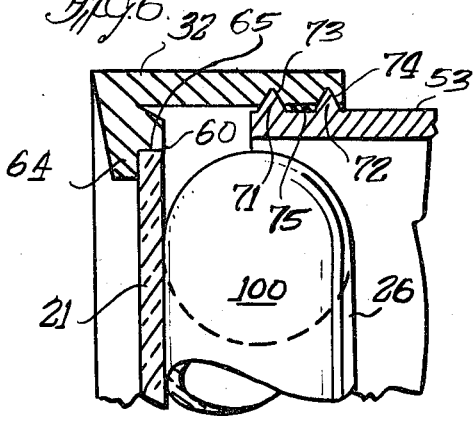
FIG. 6 is an enlarged fragmentary, sectional view taken along the line 6—6 of FIG. 3 of the interconnection of a cover and housing for the device of FIG. 3.

As shown in the drawings for purposes of illustration, the invention is embodied in an illuminating device or apparatus 10 which is adapted in size and weight to be carried on a cap 11 such as a hard hat used by construction workers or miners. The illuminating device includes a power cable 12 which extends from the hat and the illuminating device to a portable battery 14 which can be clipped to the belt of the user by means of a clip 15. To be safe and commercially acceptable, the illuminating device 10 should be small enough to sit above the front rim of the cap and not project substantially beyond the sides of the hat and be lightweight and meet safety codes.

The most common illuminating devices embody an incandescent bulb such as the incandescent bulb 20 which is disposed behind a glass lens 21 and which is located at the focal point of a reflector 23 to provide a spot beam of light. Typically, the incandescent lamp provides about 40 to 50 lumens of light from the battery 14. In mines such as coal mines, the spot beam does not provide much peripherally reflected light as there is not a great deal of light reflecting materials which the beam hits. It has been recognized, as disclosed in U.S. Pat. Nos. 3,953,725 and 4,002,895 that more lumens, for example, 200 or 300 lumens with better peripheral lighting can be achieved by the use of a fluorescent bulb in a miners cap illuminating device. A problem with the illuminating devices of these patents, which are assigned to the assignee of this patent application, is that of the relatively long width of the package housing which exceeds substantially in the horizontal direction the usual width of the front of the hat. It should be appreciated that the smaller package is most desirable from a safety standpoint as being less likely to be hit by or caught on an obstruction while the miner is working. Further the fluorescent bulb uses alternating current and needs a substantially higher voltage for operation than that available from the direct current battery source. Thus, the addition of suitable ballast to provide the alternating current for the illuminating device also adds to its bulk. Additionally, the illuminating device must be rugged and must meet several safety standards so that it will not ignite methane gas.

In accordance with the present invention, an illuminating device 10 has been provided with the capability of illuminating with either the conventional spot beam or with a wider and more peripheral lighting as desired for more close up work. This has been achieved by mounting both the incandescent bulb 20 and a fluorescent bulb 26 within a housing means 25 and providing a circuit means 27 which selectively energizes either the incandescent bulb 20 or the fluorescent bulb 26. The light from the latter is directed forwardly by the reflector 23 but is also projected laterally outward from the sides of a cover 30 having transparent sides 32.

In accordance with an important aspect of the invention, the ability to package both the incandescent bulb 20 and the fluorescent bulb 26 in a small housing means 25 is achieved by providing a curved fluorescent bulb 26 encircling, at least in part, the incandescent bulb 20. The preferred fluorescent bulb is a U-shaped bulb which is inverted.

Figure 4:
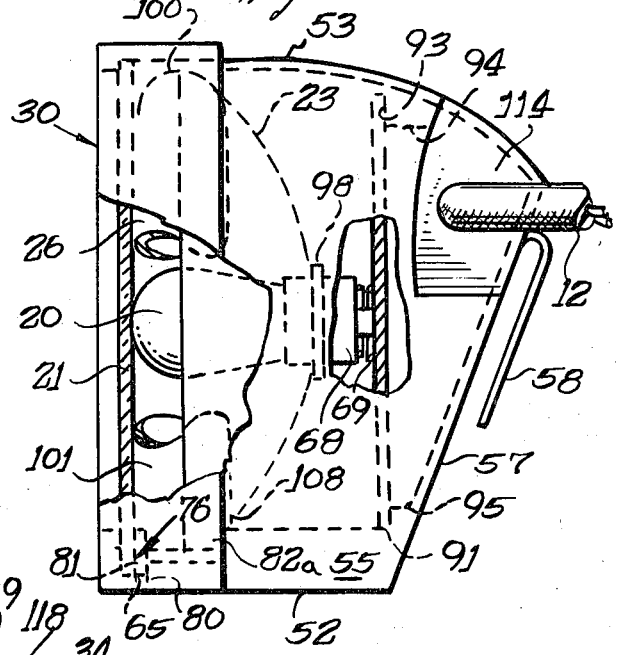
FIG. 4 is a side elevational view of the device of FIG. 3 partially broken away.
Figure 5:
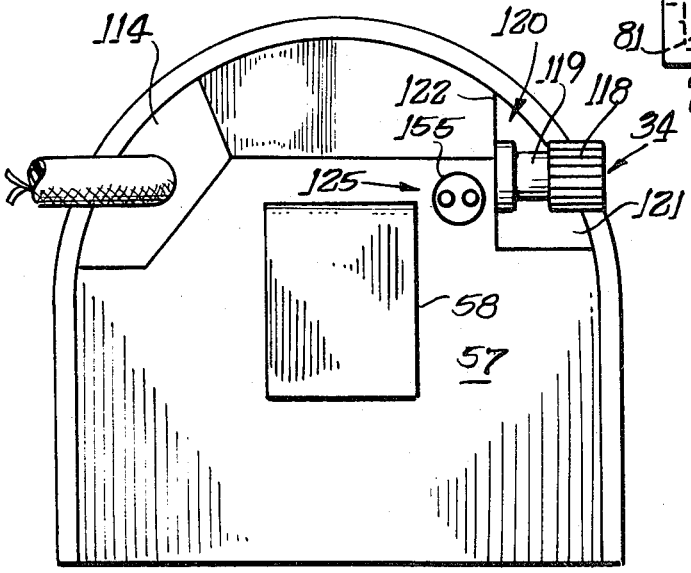
FIG. 5 is a rear view of the caplight device.
Figure 7:
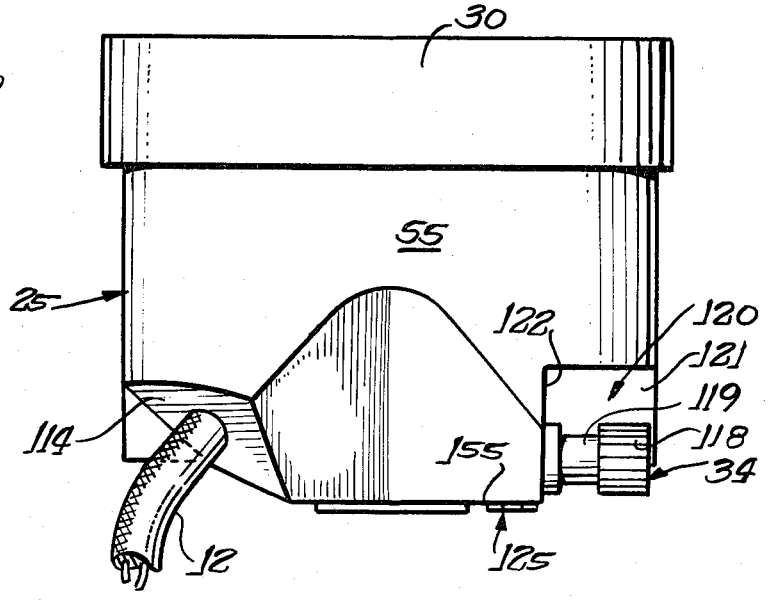
FIG. 7 is a plan view of the device of FIG. 3.
Figure 8:
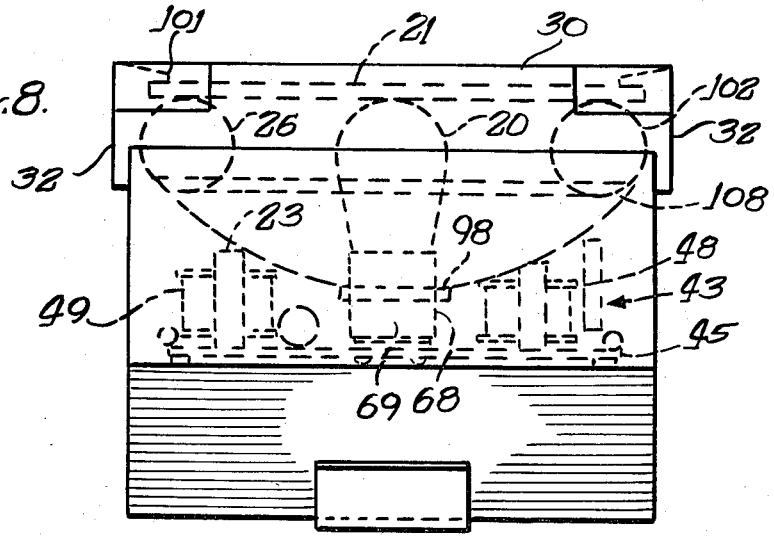
FIG. 8 is a plan view showing the internal components of the device.
Figure 9:
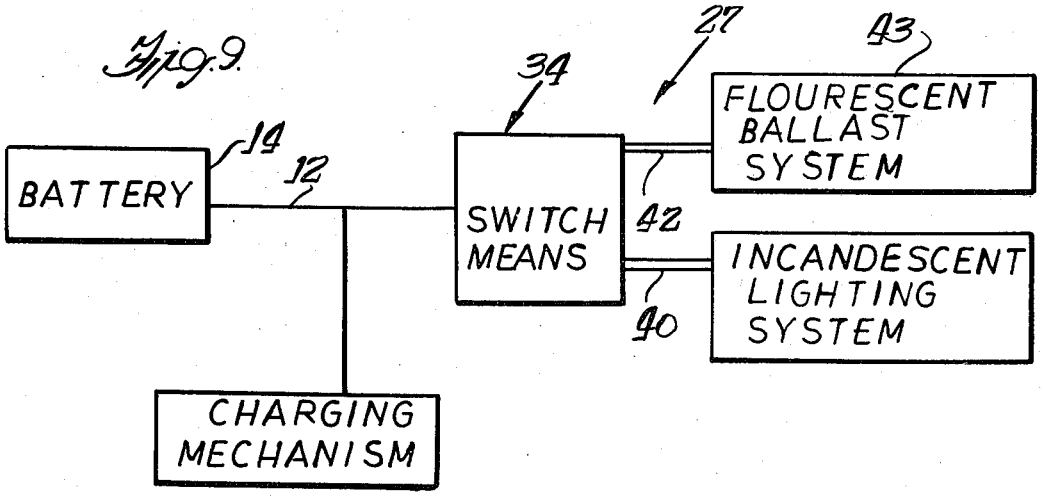
FIG. 9 is a schematic electrical diagram.

Also, in accordance with an important aspect of the invention, a switch means 34 is provided on the housing means 25 for operation by the user to switch between the respective light sources or to turn off both of the bulbs 20 and 26. The switch means 34 is connected into a circuit such as shown in FIG. 9 and connects the battery 14 through power cord 12 to deliver direct current at the battery voltage to the switch means 34. From the switch means 34 are a set of leads 40 extending directly to the incandescent bulb 20. Another set of leads 42 carry the direct current from the switch means 34 to a ballast means 43 for the fluorescent lamp. Herein, the ballast means 43 is mounted and comprises a circuit board 45 mounted within the housing means behind the reflector 23, as best seen in FIGS. 4 and 8. The ballast means is a conventional circuit and hence will not be described in detail but it include components (FIG. 8) such as a transformer 48 and an inductor 49 as well as resistors, capacitors, diode and a transistor. The ballast means functions to provide a high starting voltage of approximately 150 volts of alternating current to ignite the fluorescent bulb and to provide a steady operating voltage of about 40 or 50 volts from the battery voltage which may be approximately four volts. On the other hand, if a higher voltage battery is used, the higher direct current from the battery may be used directly without conversion to alternating current to ignite and run the fluorescent bulb.

Referring now in greater detail to the individual components of the illuminating device 10, the preferred housing means 25 is generally blockshaped which measures approx. 3.5 inches between vertical upstanding side walls 50 and 51 and which is approximately 3.5 inches in height between a bottom wall 52 and an upper curved wall 53. The housing means preferably is a molded plastic body 55 of one-piece construction having a back wall 57 inclined upwardly and rearwardly from the bottom wall 52 as best seen in FIG. 4. The inclined back wall is disposed to parallel a similar wall on the hard hat 11. The back wall carries a spring metal, clip 58 which is clipped to a receiving clip on the hard hat and the clips allow the illuminating device 10 to readily attached or detached from the hard hat, as for frequent recharging of the battery 14.

The preferred front cover 30 is made of clear, transparent plastic and is also a one-piece molded body with a circular opening 62 on its front face 63. More specifically, the circular opening 62 is defined by a circular flange or lip 64 which is located outwardly of and which projects radially inwardly of and supports a rim 60 of the circular glass lens 21. The lens rim 60 is fitted in a circular recess 65 immediately behind the lip 64. The glass lens may be suitably adhered as by adhesive to the lip 64 to define a sealed surface which will not admit methane gas, dust, dirt or other contaminants into the interior of the housing body. Preferably, the incandescent bulb 20 has its outer edge abutted against the center of the glass lens 21 and is mounted in a socket 68 which has a spring ejector 69 so that if the glass lens 21 is broken, the incandescent bulb 20 is automatically pushed forward by the spring 69 to break the circuit to the bulb 20 so that it will not ignite any methane gas. This spring biased bulb and disconnect is conventional, and hence will not be described further herein.

The front cover 30 is detachably connected to the front of the housing body and is sealed thereto. In this instance, the outer peripheral edge of the housing body may be provided with a pair of spaced, exterior beads 71 and 72 which project outwardly from and about the top housing wall 53 and down along the housing sidewalls 50 and 51. Matching grooves 73 and 74 on the cover side will slide into mating contact with the housing beads 71 and 72 to prevent fore and aft movement of the cover relative to the housing. When the cover 30 is slid down along the sides of the housing, the top arcuate grooves in the cover will contact the arcuate beads at the top of the housing to complete the sealing between the beads 71 and 72 and the grooves 73 and 74. A suitable gasket 75 may also be provided between the projecting beads 71 and 72 for hermatically sealing about three sides of the cover and housing interface.

At the bottom of the cover 30, a suitable gasket 76 extends along the lower horizontal edge 81 of the cover and is abutted against a lower facing housing wall 80. Suitable fasteners such as rivets 82 may be attached at opposite ends of the lower cover edge 81 and extended into integral fastener receiving bosses **82*a* in the housing. Thus, it will be understood that to remove the cover, the rivet fasteners 82 must be removed and the cover slid upwardly with the grooves 73 and 74 of the cover 30 sliding upwardly along the projecting beads 71 and 72 until the front cover 30** is lifted from the housing body.

Within the hollow interior of the housing means 25 and adjacent the back thereof, is mounted the circuit board 45 which has its lower end rested on a horizontal internal wall 91 of the housing means. The upper edge of the circuit board is abutted against a vertically extending face 93 of bosses 94 molded in the housing wall. A similar lower boss has a vertical lower face 95 against which is positioned the lower horizontally extending edge of the circuit board. The circuit board may be secured to the housing by fastening means such as rivet fasteners or suitable adhesives.

The lamp socket 68 is secured to the center portion of the circuit board 45. The dish-shaped reflector 23 is curved forwardly from a central rear portion 98 located about the socket 68. Into the space behind the reflector 23 is positioned the transformer 48 and inductor 49 along with other electrical components for the ballast and mounted on the circuit board 45, as shown in FIG. 8.

The reflector 23 has its forward edge or rim 108 located immediately behind the upper curved portion 100 of the U-shaped bulb with the lower legs 101 and 102 of the U-shaped fluorescent bulb extending down through cut-outs in the bottom of the reflector. That is, cut-out walls 104A, 104B, and 104C are cut into the reflector. The reflector may be secured to the housing by suitable adhesives or fasteners (not shown).

From each of the lower ends 101 and 102 of the bulb 26 extends a pair of leads 109 and 110 to the ballast for connection thereto. The electrical power cable 12 is connected to an inclined upper rear side wall 114 of the housing with a set of internal conductor leads (not shown) being run over to the switch means 34. From the switch means a set of leads 40 extend to the socket 68 for the incandescent bulb 20 and a second set of leads 42 extend from the switch means 34 to the ballast means for the fluorescent bulb.

The preferred switch means 34 is a rotatable switch having an outer knurled head 118 fastened onto a turnable shaft 119 extending inwardly through the housing wall to a three function switch (not shown) inside the housing. The switch head 118 is fitted into a small cut out or recess 120 defined on rear upper position of the housing body by a downwardly and rearwardly inclined wall 121 which meets a fore and aft extending wall 122. A battery recharge receptacle 125 is fitted on the rear wall 155 for connection to the power cable 12. Thus, the battery 14 may be recharged in the usual manner by removal of the lighting device 10 from the hard hat and attaching the receptacle 125 to the battery recharging circuit (not shown).

From the foregoing, it will be seen that the wearer may turn his switch handle 118 to a first position to connect the battery 14 over cable 12 and switch 34 to the leads 40 to light the incandescent light bulb 20 which will provide a spot beam of about 40 to 50 lumens. Some light rays go radially outwardly from the bulb through the clear transparent sides of the front but the U-shaped bulb 26 will block most of this light from going out peripherally of the device. Since the lamp bulb 20 is at the focal point of the reflector 23, it will produce a forwardly directed beam in the convention manner.

By turning the switch handle 118 to its second position, the battery is connected by the power cable 12 and switch means 34 to the ballast means which provides an alternating current of about 150 volts for starting of the bulb 26 and then provides a voltage of about 40 or 50 volts for steady fluorescent light. The lamp 26 should produce about 100 to 130 lumens at four watts at the temperatures encountered.

The inverted U-shaped bulb should direct the light down in front of the wearer and the transparent sides of the cover 30 allow light to be directed peripherally about the device.

When turned to a third position, the switch means 34 will be "off" with no power going to either of the bulbs 20 or 26. Preferably, the switch means is a durable switch and has a low voltage drop thereacross. Typically, the battery 14 lasts for ten hours without being recharged. Since the interior of the housing is sealed, the incandescent bulb should not ignite any methane gas and no dust or foreign matter should penetrate the housing means. Because the filaments of the fluorescent bulb 26 operates at a lower temperature, it need not have an automatic disconnection device as does the higher temperature incandescent bulb 20 which is disconnected when the glass lens or bulb 20 is broken.

From the foregoing, it will be seen that the illuminating device is small, lightweight, rugged, and sized to fit onto a cap and provide the wearer with dual light capabilities, one being a spot beam and the other being a wider and brighter light. The use of a curved fluorescent bulb in the same place with and about the incandescent bulb results in a small configuration as contrasted to the elongated housing disclosed in the aforementioned patents.

Various changes and modifications may be made in the above-described method and apparatus without deviating from the spirit or scope of the present invention. Various features of the invention are set forth in the accompanying claims.

I claim:

1. A lighting device for attachment to a protective cap, said lighting device comprising a housing means configured and sized to be worn on and attached to the cap, and incandescent bulb in said housing means for generating light for illumination forwardly of the cap, a fluorescent bulb in said housing means for generating light for illuminating peripherally and forwardly of the cap, a reflector fixedly mounted in said housing means for directing light from either said incandescent or said fluorescent bulb, means mounting said incandescent bulb at a fixed location in said housing means and a fixed location with respect to said reflector and said fluorescent bulb, means mounting said fluorescent bulb at a fixed location in said housing means and at a fixed location with respect to said reflector and said incandescent bulb, and electrical means for selectively energizing each of said incandescent bulb and said fluorescent bulb depending upon the light desired by the wearer.

2. A lighting device in accordance with claim 1 including a switch means for operation to turn off both of said bulbs and for separately energizing either said fluorescent or said incandescent bulb.

3. A lighting device in accordance with claim 1 in which said fluorescent bulb comprises a curved bulb within said housing means.

4. A lighting device in accordance with claim 3 in which said curved bulb is a U-shaped bulb.

5. A lighting device in accordance with claim 4 in which said bulb has its curved portion located upwardly and is substantially coplanar with the incandescent bulb.

6. A lighting device in accordance with claim 1 in which a reflector means is located rearwardly of said incandescent bulb and in which said fluorescent bulb partially encircles said incandescent bulb and is substantially coplanar as therewith.

7. A lighting device in accordance with claim 1 in which a transparent cover is attached to and covers the front portion of the housing means and a glass lens is supported within said cover.

8. A lighting device for attachment to a protective cap, said lighting device comprising a housing means configured and sized to be worn on and attached to the cap, a reflector in said housing means, a first bulb in said housing means for generating a spot beam of light directed by said reflector for illumination forwardly of the cap, a second bulb in said housing means for generating more dispersed light for illuminating peripherally and forwardly of the cap, said reflector being fixed in said housing means and operable with each of said first and second bulbs to direct light from either of said bulbs from said housing means, means mounting said first bulb at a fixed location in said housing means at the focal point of said reflector, said second bulb having at least a portion surrounding said first bulb, means mounting said second bulb in a fixed location for said housing means.

9. A lighting device in accordance with claim 8 in which said second bulb is a fluorescent bulb having a curved bulb within said housing means and said first bulb is an incandescent bulb.

10. A lighting device in accordance with claim 9 in which said curved bulb is a U-shaped bulb with its curved portion located upwardly and being substantially coplanar with the incandescent bulb.

11. A lighting device in accordance with claim 9 in which said electrical means comprises a circuit within said housing for providing alternating current to said fluorescent bulb and direct current to said incandescent bulb.

12. A lighting device for attachment to a protective cap, said lighting device comprising: a one piece housing means of plastic configured and sized to be worn on and attached to the cap, a glass lens in said housing means, an incandescent bulb in said housing means for generating light for illumination forward of the cap and abutting said glass lens, a curved fluorescent bulb in said housing means for generating light for illuminating peripherally and forwardly of the cap, a reflector in said housing means for reflecting light forwardly from said incandescent or fluorescent bulbs, said reflector being stationary in said housing means means mounting said curved fluorescent bulb in a stationary location in the housing means and a fixed position with respect to said incandescent bulb, circuit means for energizing said incandescent bulb with direct current and said fluorescent bulb with alternating current, and switch means operable by the wearer to switch between the incandescent bulb and the fluorescent bulb.

13. A lighting device in accordance with claim 12 in which said fluorescent bulb comprises a curved bulb within said housing means and encircling, at least partially, said incandescent bulb.

14. A lighting device in accordance with claim 12 in which a removable front cover holds said glass lens in position on said housing means, said front cover being formed with transparent side walls to allow light to pass through.

* * * * *